US005189953A

United States Patent [19]

Kennedy et al.

[11] Patent Number: 5,189,953

[45] Date of Patent: Mar. 2, 1993

[54] ELECTRIC MOTOR DRIVEN IMPRINTER

[75] Inventors: Randall J. Kennedy; David A. Moritz, both of Kitchner, Canada

[73] Assignee: Consolidated NBS, Inc., Mississauga, Canada

[21] Appl. No.: 886,154

[22] Filed: May 21, 1992

[51] Int. Cl.[5] ..... B41F 3/04

[52] U.S. Cl. ..... 101/269; 101/45

[58] Field of Search ..... 101/44, 56, 269-274, 101/283

[56] References Cited

U.S. PATENT DOCUMENTS

| | | | |
|---|---|---|---|
| 3,232,230 | 2/1966 | Sheldon | 101/269 |
| 3,269,307 | 8/1966 | Bell, Jr. et al. | 101/269 |
| 3,416,441 | 12/1968 | Maul et al. | 101/56 |
| 3,420,171 | 1/1969 | Maul et al. | 101/269 |
| 3,447,459 | 6/1969 | Maziarka | 101/269 |
| 3,461,799 | 8/1969 | Blair | 101/269 |
| 3,494,282 | 2/1970 | Gruss | 101/45 |
| 3,623,426 | 11/1971 | Gruss | 101/45 |
| 3,800,700 | 4/1974 | McInnis et al. | 101/269 |
| 3,858,640 | 10/1974 | Correll et al. | 101/269 |
| 3,983,802 | 10/1976 | Thomson et al. | 101/45 |
| 4,070,966 | 1/1978 | Edon | 101/269 |
| 4,085,675 | 4/1978 | Yoshikawa et al. | 101/45 |
| 4,227,453 | 10/1980 | McInnis | 101/269 |
| 4,233,542 | 2/1981 | Minardi | 101/269 |
| 4,423,679 | 1/1984 | Maul | 101/269 |
| 4,437,404 | 3/1984 | Barbour | 101/269 |
| 4,655,132 | 4/1987 | Weickert et al. | 101/269 |
| 4,704,963 | 11/1987 | Nishimura et al. | 101/425 |
| 4,715,298 | 12/1987 | Weickert et al. | 101/56 |
| 4,802,412 | 2/1989 | Edwards et al. | 101/269 |

*Primary Examiner*—Eugene H. Eickholt

*Attorney, Agent, or Firm*—Antonelli, Terry, Stout & Kraus

[57] ABSTRACT

An electric motor driven imprinter (60) in accordance with the invention includes a base (70) for receiving a print bearing element (62) having printing to be imprinted on a print receiving element (64) with the electric motor being mounted in the base; a head (61) pivotally connected to the base for imprinting; a movable carriage (116) mounted on the head having mounted therein a rolling platen (128) driven by the electric motor (82) to move the carriage in a first direction and a second opposite direction along a longitudinal axis with movement in each direction to one of a pair of ends of travel (110,.112) imprinting print from the print bearing element on the print receiving element; a capstan (84) which is driven by the motor; and a cable (86) attached to the capstan, forming a loop between the capstan and an idler wheel (142) attached to the head at a point along a longitudinal axis of the head adjacent an end of travel spaced farthest from the capstan and attached to the movable carriage.

38 Claims, 6 Drawing Sheets

ELECTRIC MOTOR DRIVEN IMPRINTER

DESCRIPTION

1. Technical Field

The present invention relates to electric motor powered imprinters which imprint a printed record on a formset from one or more print bearing elements of the type commonly used for credit transactions. More particularly, the invention relates to imprinters of the aforesaid type which have a surface which receives print bearing elements and a formset to be imprinted in preparation for imprinting when a head mechanism carrying a rolling platen is in an open position and which imprints the formset when the head mechanism is in a closed position. The invention is particularly applicable to imprinters for imprinting formsets having multiple layers of the type used in hospitals.

2. Background Art

Imprinters have been used for many years to record credit transactions. Typically, an imprinter is a manually operated device in which a customer's credit card and merchant's station plate, a dater and optionally, a variable money amount printing mechanism are located on different parts of a surface which receives a formset to which an imprint of the aforementioned elements is transferred by the rolling of a rolling platen over the formset. In addition of the above-described manually operated imprinters, motor operated imprinters have been in use for many years which use an electric motor to activate the transversal of the rolling platen across a formset to generate an imprint. These systems relieve the operator of the requirement of manually supplying the power for performing the imprinting operation. U.S. Pat. Nos. 3,232,230, 3,233,542, 3,269,307, 3,416,441, 3,420,171, 3,447,459, 3,494,282, 3,623,426, 3,800,700, 3,838,640, 4,085,675, 4,227,453, 4,423,679 and 4,802,412 each disclose motor operated imprinters and U.S. Pat. Nos. 4,655,132 and 4,715,298 which are assigned to the Assignee of the present invention disclose a motor operated imprinter.

These imprinters functionally belong to four main types. The first type, which includes those imprinters disclosed in U.S. Pat. Nos. 3,232,230, 3,233,542, 3,269,307 and 3,838,640, have heads which are mounted on a fixed track which is traversed from a position offset from the printing surface across the printing surface and back. These imprinters permit the user to easily position the credit card and formset on the printing surface but suffer from the disadvantage that they are not compact in length because of the fact that the head is parked in a position offset from the printing surface. The second type of imprinter, which are disclosed in U.S. Pat. Nos. 3,269,307, 3,416,441, 3,420,171, 3,494,282, 3,623,426 and 4,437,404, has a pivoted head which is generally vertically disposed for receiving the formset and credit card to be imprinted. The printing operation of these imprinters is activated by the closing of the head into a latched position. A rolling platen fixedly mounted within the stationary base is traversed across the formset by the activation of the motor when the head is rotated to its latched position. These imprinters can be difficult to use because of the necessity to insert the customer's credit card and formset into the generally vertically disposed head mechanism, especially under circumstances where lighting conditions are not bright, such as occurs in bars and restaurants. The third type of imprinter is disclosed in U.S. Pat. Nos. 3,800,700, 4,085,675, 4,227,453, 4,655,132 and 4,715,298 which has a generally horizontally disposed surface for receiving the credit card to be imprinted and the formset while a pivotable head is in an open position in preparation for imprinting and which imprints the formset upon latching of the head in the closed position. The fourth type of imprinter, which is disclosed in U.S. Pat. Nos. 3,800,700, 4,085,675 and 4,227,453 has the electric motor located within the pivotable head. The aforementioned types of imprinters, with the exception of the imprinter disclosed in U.S. Pat. No. 3,800,700, imprint the formset during the forward stroke and return the rolling platen to its rest home position without imprinting during each cycle of imprinting. The requirement for a forward and a reverse stroke of the rolling platen lengthens the overall imprinting process and creates a perception on the part of the user that the imprinter is not "fast".

The imprinter disclosed in U.S. Pat. No. 3,800,700 is driven by a reversible motor with each imprint cycle utilizing movement of the imprinter in only one direction. The imprinter of the '700 patent makes a first imprint when the rolling platen is moved from a first position to a second position. The next imprint is made by reversing the direction of rotation of the motor and moving the rolling platen from the second position to the first position. The Farrington Model 5000 electric imprinters and the Data Card Model 850-855 and 860-865 imprinters are based upon the imprinter disclosed in the '700 patent.

The Assignee of the present invention markets a Model 306 electric credit card imprinter for applications such as hospitals in which thick formsets having multiple pages are utilized. The imprinter of thick formsets (those thicker than in a typical credit transaction at a merchant) requires a more robust machine as a consequence of the higher pressure necessary to clearly imprint the multiple pages of the formset. The Model 306 imprinter has an endless loop bicycle chain and a scotch yoke which drives a rolling platen. Power is coupled from the chain to the platen by means of a roller carried by the chain which rotates in a slot of the scotch yoke. As the endless chain rotates around an idler roller, the roller moves in the slot to reverse the direction of movement of the rolling platen to move it back from its second position at which imprinting is completed to its first position where imprinting was begun. This design has a number of disadvantages including excessive size of the chain sprocket drive and scotch yoke, slowness of operation because of the weight of the overall moving parts driven by the electric motor and the requirement of a heavy duty gearbox in order to transmit the requisite power to the mechanism for driving the rolling platen. Furthermore, the operation is noisy and expensive to manufacture. Finally, the Model 306 does not have a pivoted head which limits the length of the form which may be inserted through an opening at the end of the machine. The Model 306 was intended for applications in hospitals in which a multiple page form is often imprinted at several different locations on the form during a patient's treatment in the hospital. The length and width of the formset imprinted at one end of the machine required the overall machine to be large in order to accommodate the necessary length and width of formset typically used in a hospital application.

The Farrington Model 5000 imprinter, Data Card Models 850-855 and 860-865 and the imprinter disclosed in U.S. Pat. No. 3,800,700 each have the electric motor for driving the rolling platen located in the pivotable head of the machine. This design creates difficulties during the operation of the machine over its useful lifetime. In the first place, counterbalancing of a pivotable head which includes the motor and transmission is difficult in order to provide the head with sufficient return capability to its open position after imprinting is completed without providing the head with too much return capability provided by return springs which tends to cause a severe impact making the machine jump from its place of rest. Over the life of a machine, the mechanism for arresting the rotation of the head tends to wear which causes the head opening mechanism to progressively open at a faster rate which increases the likelihood of the impact of the head at the fulling opening position causing the imprinter to jump substantially.

It is desirable that power for imprinting which drives the rolling platen mounted in a carriage within a pivotable head be transmitted from an electric motor located in the base of the imprinter. If is further desirable that the transmission of power between the base and the pivotable head be simple, reliable, inexpensive and light in weight.

FIG. 1 illustrates a prior art reversible electric motor 10. A single pole double throw switch 12 has a first terminal 14 which is connected to one electric conductor which is coupled to a source of AC power 16. The second and third terminals 18 and 20 are respectively electrically connected to the first terminal 14 in response to a movable member (not illustrated) which moves pole 22 between contact with the second and third terminals. A capacitor 24 is connected between the terminals 18 and 20. A first motor winding 26 has a first terminal 28 which is connected to the terminal 30 of the capacitor and the terminal 20 of the switch 12. A second winding 32 has a first terminal 34 which is connected to a second terminal 36 of the capacitor 24 and the terminal 18 of the switch 12. The windings 26 and 32 have a second terminal 38 which is connected together. The second terminal 38 is connected to the second conductor of the AC source of power 16. Positioning of the pole 22 of the switch 12 to contact the second terminal 18 or the third terminal 20 to the source of power 16 through terminal 14 determines the direction of rotation of the motor by shifting the electrical phase of electric current applied to the windings to produce clockwise or counterclockwise rotation in a conventional fashion. The reversible motor of FIG. 1 is utilized conventionally with induction motors.

DISCLOSURE OF INVENTION

The present invention is an electric motor driven imprinter of the type having the electric motor in the base and a transmission coupling power from the base to a head pivotally connected to the base which is pivotable between an open position providing access to the base to position a print receiving element such as a formset and a print bearing element such as a credit or identification card and a closed position positioning the head for imprinting with the transmission providing power to a movable carriage mounted in the head having mounted therein a rolling platen driven by the electric motor to move the platen in a first and second opposite direction with movement in each direction to one of a pair of ends of travel of the rolling platen imprinting print from a print bearing element on a print receiving element. The head is pivoted from a pivot axis orthogonal to the longitudinal axis of the head and the direction of travel of the carriage at a position offset from the print receiving element to permit formsets to be positioned at multiple locations along the length of the formset while the head is in the open position. The location of the electric motor in the base with the transmission for coupling power to the rolling platen mounted in the head provides a lightweight head with a reduced size which rapidly performs imprinting by movement of the rolling platen alternatively in the first and second directions. The transmission utilizes an endless loop which is connected to a capstan driven by the electric motor mounted in the base and which is connected to an idler roller mounted at an end of the head opposite to the pivot axis of the head with the endless loop being attached to the carriage along a single longitudinal section of the carriage inboard of rollers rotatably supporting the carriage during imprinting. A reversible electric motor drives the capstan with the direction of rotation of the motor being reversed during successive cycles of the rolling platen by contacting a control mechanism having stops respectively located at the first and second ends of travel of the carriage which move the pole of a single pole, double throw switch from connecting a first terminal alternatively to one of second and third terminals each time the control member is contacted by the carriage reaching an end of travel.

The location of the motor in the base of the imprinter with an endless loop driven by a capstan driven by the electric motor provides a lightweight transmission of power to drive the rolling platen attached to the carriage which is movable between the ends of travel alternatively during successive imprinting cycles. As a result, the head is not increased in weight with the motor drive as typical of the prior art, with the exception of the Assignee's electric credit card imprinter disclosed in U.S. Pat. Nos. 4,655,132 and 4,715,290, which simplifies the mechanism for opening the head at the end of imprinting by lessening the mass of the head by positioning the motor in the base of the imprinter. Furthermore, the imprinting in alternative directions in moving the carriage to the ends of travel in the head provides a high speed imprinting cycle.

The mechanism for latching the imprinter in a closed position is opened by the movement of the carriage to either of the ends of travel of the carriage. Movement of the carriage to either of the ends of travel moves a control mechanism which unlatches the head mechanism from its closed position to permit pivoting to its open position for the next imprinting cycle. First and second carriage stops are located respectively at the ends of travel of a carriage which cause the control mechanism to unlatch the head from the closed position. The control mechanism includes a first member which is directly attached to one of the carriage stops and a second member which is connected to the first member to cause the first member to move in a direction opposite to the second member to unlatch the head when the carriage moves to an end of travel which does not directly move the first member.

The control of the direction of rotation of the motor is successively reversed by utilization of a single control switch which is alternatively moved between connecting a first terminal to a second terminal or a third terminal during successive cycles of the carriage in moving to the respective ends of travel. As a result, only a single switch is required to reverse the direction of rotation of the electric motor to provide successive cycles of imprinting which imprint respectively in first and second opposite directions of movement of the carriage in the head. The simplified motor control mechanism which is activated by movement of the carriage to the ends of travel permits the activation of the electric motor to be controlled with two switches with one of the switches being closed upon latching of the head in the closed position and the other switch being alternatively positioned between connecting the first terminal to the second terminal and to the third terminal to reverse the direction of rotation of the motor for the next cycle of imprinting by movement of the carriage in a direction opposite to the direction of the previous imprinting cycle. As a result, printing is performed at high speed without the necessity of returning the carriage to a home position for each imprinting cycle.

An electric motor driven imprinter in accordance with the invention includes first and second motor windings each having a first terminal for coupling to a source of electric power and a second terminal connected together for coupling to the source of electrical power; a base for receiving a print bearing element having printing to be imprinted and a print receiving element to be imprinted with the electric motor being attached to the base; a head pivotally connected to the base which is pivotable between an open position providing access to the base and a closed position positioning the head for imprinting; a movable carriage mounted in the head having mounted therein a rolling platen driven by a transmission coupling the motor to the carriage to move the platen in a first and a second opposite direction with movement in each direction to one of a pair of ends of travel of the carriage imprinting print from the print bearing element on the print receiving element; a first switch having a first terminal for connection to the source of electrical power and, alternatively, to one of second and third switch terminals respectively electrically connected to the first terminal of the first and second motor windings and to a capacitor with the alternative connection to the second and third switch terminals being controlled by a first control mechanism which is activated when the carriage moves to the end of travel in either the first or second direction; and a second switch coupled to the motor windings with the second switch being controlled by a second control mechanism to close the second switch in response to pivoting the head to the closed position so that current flows through the closed second switch through the electric motor and the electric motor is activated when current flows through the switches and the motor windings from the source of electrical power with the direction of rotation being controlled by the end of travel at which the carriage is positioned at the time of closing the head. The transmission couples the electric motor to the carriage with a flexible coupling which bends upon pivoting the head. The transmission comprises a capstan which is driven by the motor to rotate in first and second rotational directions; a cable attached to the capstan, forming a loop between the capstan and an idler wheel attached to the head and attached to the movable carriage so that rotation of the capstan in the first rotational direction moves the carriage in the first direction and rotation of the capstan in the second rotational direction moves the carriage in the second direction. The capstan is attached to the base and the transmission further comprises an idler rotatably attached to the base against which the loop rests when the head is pivoted to the open position to form a pivot point of the loop between the base and the head when the head is in the open position. The imprinter further includes a pair of rails mounted in the head each having a first surface which engages the carriage for limiting movement of the movable carriage in a third direction of carriage movement perpendicular to the first and second directions; a plurality of rollers mounted on first and second sides of the carriage outboard of the rolling platen which engage a second surface of the pair of rails opposed to the first surface to rotatably support the carriage during imprinting and limit movement of the movable carriage in a fourth direction of carriage movement opposite to the third direction of carriage movement; and wherein the loop is attached longitudinally to the carriage inboard of the rollers. The first control mechanism comprises a member slidable attached to the head to move parallel to the directions of travel of the carriage during imprinting and having first and second stops disposed at opposed ends of the member which respectively are contacted by movement of the carriage to each end of travel with contact of the carriage with the first stop causing the first terminal of the first switch to be connected to the second terminal of the first switch and with contact with the second stop causing the first terminal of the first switch to be connected to the third terminal of the first switch. The second control mechanism is slidable attached to the head and movable between first and second positions with the first position not opening a latching mechanism and the second position contacting the latching mechanism and opening the latching mechanism to permit the head to pivot to the open position. The second control mechanism comprises a first carriage stop which is movable parallel to the direction of travel which contacts the carriage at one end of travel of the carriage and causes the latching mechanism to open as the carriage approaches the one end of travel; and a second carriage stop which is movable parallel to the direction of travel which contacts the carriage at another end of travel of the head and causes the latching mechanism to open as the carriage approaches another end of travel. The second control mechanism further comprises a first member attached to the first carriage stop which engages the latching mechanism to open the latching mechanism when the carriage approaches the end of travel; and a second member attached to the second carriage stop and to the first member which engages the latching mechanism to open the latching mechanism when the carriage approaches the other end of travel. The second member has two parts which are pivotally attached together, the first part being attached to one of the carriage stops and the second part being pivotally attached to the head at a point offset from the pivotal attachment to the first part and pivotally attached to the first member at a point offset from the pivot point of attachment to the head with a distance between the pivot point of the parts and the point of attachment of the second part to the first member being greater than a distance between the pivot point of the parts and the point of attachment of the second member to the head.

An electric motor driven imprinter in accordance with the invention includes a base for receiving a print bearing element having printing to be imprinted and a print receiving element to be imprinted with the electric motor being mounted in the base; a head pivotally connected to the base which is pivotable between an open position providing access to the base and a closed position positioning the head for imprinting with a pivot axis of the head being orthogonal to a longitudinal axis of the base and directions of travel of the carriage during imprinting and the head being pivotally attached to the base at a position on the longitudinal axis of the base longitudinally offset from a portion of the base receiving the print bearing element and the print receiving element; a movable carriage mounted in the head having mounted therein a rolling platen driven by the electric motor to move the carriage in a first direction and a second opposite direction along the longitudinal axis with movement in each direction to one of a pair of ends of travel of the head imprinting print from the print bearing element on the print receiving element; a capstan which is driven by the motor to rotate in first and second rotational directions with the motor and capstan being attached to the base at a position farther away from the print bearing element than a point of the pivotable attachment of the head; a cable attached to the capstan forming a loop between the capstan and an idler wheel attached to the head at a point along a longitudinal axis of the head adjacent to an end of travel spaced farthest from the capstan and attached to the movable carriage so that rotation of the capstan in the first rotational direction moves the carriage in the first direction and rotation of the capstan in the second rotational direction moves the carriage in the second direction. The imprinter further includes an idler attached to the base adjacent to an end of travel closest to the capstan against which the loop rests when the head is pivoted to the open position to form a pivot point of the loop between the base and the head when the head is in the open position. The imprinter further includes a latching mechanism for latching the head in the closed position so that imprinting may be performed; a control mechanism slidably attached to the head and movable between first and second positions with the first position not opening the latching mechanism and the second position contacting the latching mechanism and opening the latching mechanism to pivot to the open position.

An imprinter driven by a reversible electric motor in accordance with the invention includes a base for receiving a print bearing element having printing to be imprinted and a print receiving element to be imprinted with the electric motor being mounted in the base; a head pivotally connected to the base which is pivotable between an open position providing access to the base and a closed position positioning the head for imprinting; a movable carriage mounted in the head having mounted therein a rolling platen driven by a transmission coupling the electric motor to move the carriage in a first direction and a second opposite direction with movement in each direction to one of a pair of ends of travel of the carriage imprinting print from the print bearing element on the print receiving element with rotation of the electric motor in a first rotational direction causing the carriage to move in the first direction and with rotation of the electric motor in a second rotational direction causing the carriage to move in the second direction; and a member slidably attached to the head movable parallel to the directions of travel and having first and second stops disposed at opposed ends of the member which respectively are contacted by movement of the carriage to each end of travel with contact of the carriage with the first stop causing the motor to rotate in the first rotational direction when electric power is applied to the motor and with contact of the carriage with the second stop causing the motor to rotate in the second rotational direction of carriage movement. The imprinter further includes a pair of rails mounted in the head each having a first surface which engages the carriage limiting movement of the movable carriage in a third direction of carriage movement perpendicular to the first and second directions of carriage movement and a plurality of rollers mounted on first and second sides of the carriage outboard of the rolling platen which engage a second surface of the pair of rails opposed to the first surface to rotatably support the carriage during imprinting and limit movement of the movable carriage in a fourth direction of carriage movement opposite to the third direction of carriage movement. The transmission couples the electric motor to the carriage with a flexible coupling which bends upon pivoting of the head. The transmission comprises a capstan which is driven by the motor to rotate in first and second rotational directions; a cable attached to the capstan, forming a loop between the capstan and an idler wheel attached to the head and attached to the movable carriage so that rotation of the capstan in the first rotational direction moves the carriage in the first direction and rotation of the capstan in the second rotational direction moves the carriage in the second direction. The capstan is attached to the base and further an idler is rotatably attached to the base against which the loop rests when the head is pivoted to the open position. The loop is longitudinally attached to the carriage inboard of the rollers. A pivot axis of the head is orthogonal to the longitudinal axis of the base and the head is pivotally attached to the base at a position on the longitudinal axis of the base longitudinally offset from a portion of the base receiving the print bearing element and print receiving element.

BEST MODE FOR CARRYING OUT THE INVENTION

Figure 2:
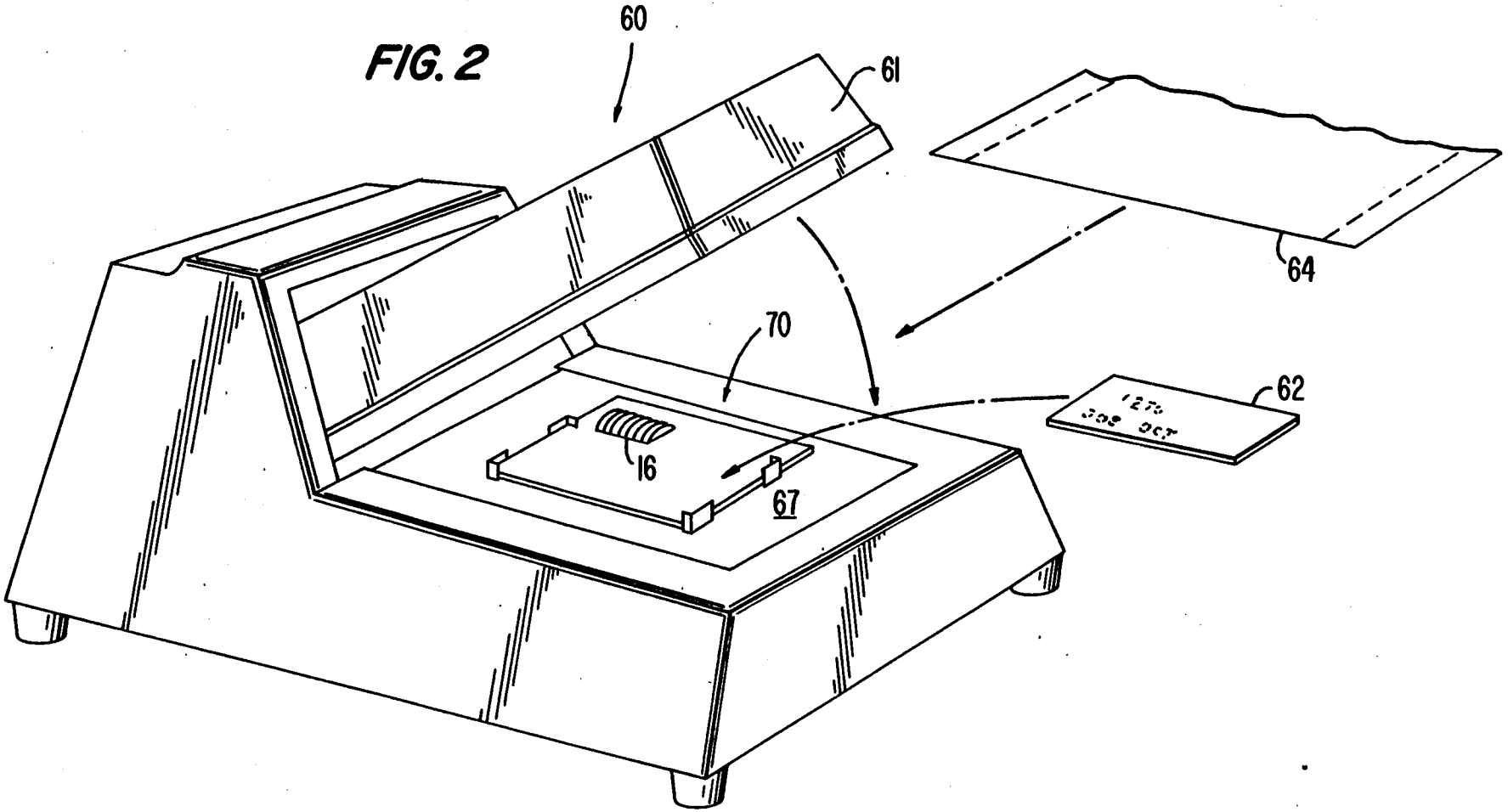
FIG. 2 illustrates an isometric view of an imprinter in accordance with the present invention with a head and base cover in place.
Figure 3:
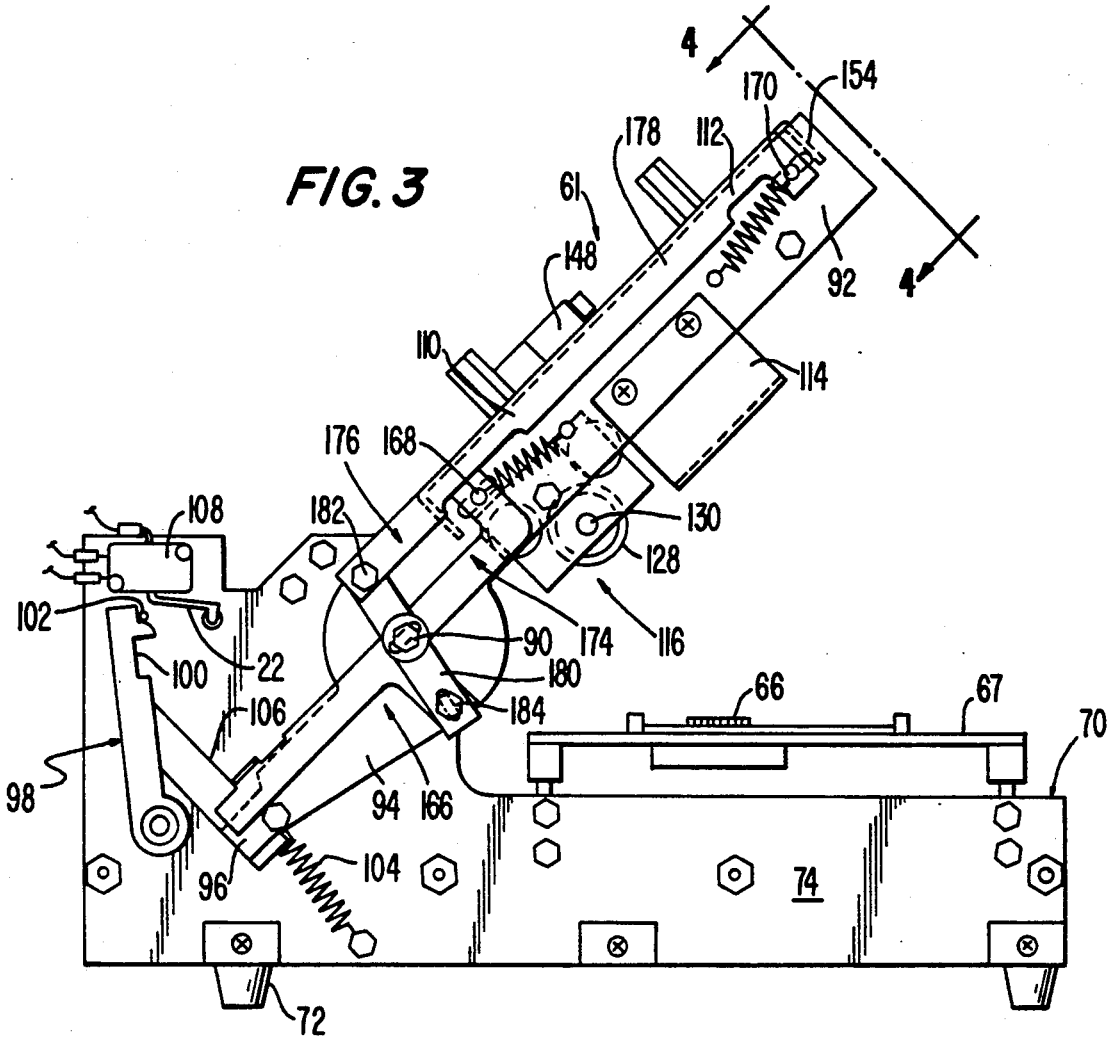
FIG. 3 illustrates a side elevational view of an imprinter in accordance with the present invention with a head and base cover removed.
Figure 5:
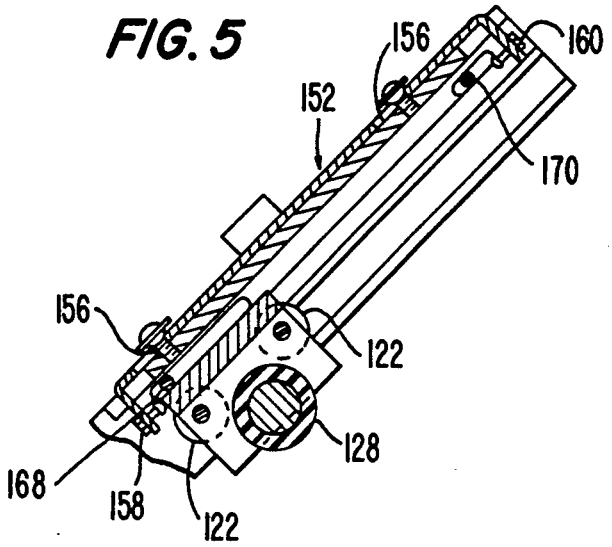
FIG. 5 illustrates a sectional view of FIG. 4 taken along section line 5—5.
Figure 4:
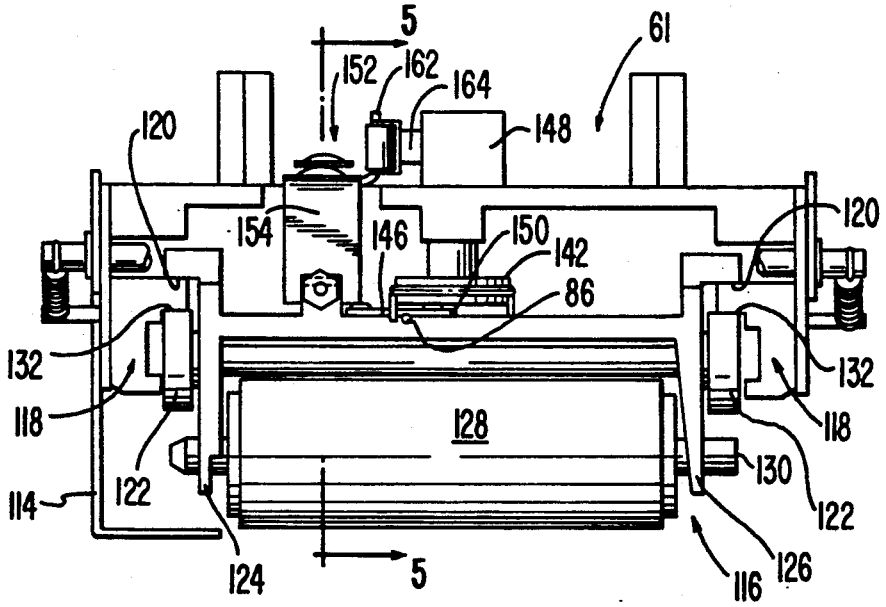
FIG. 4 illustrates a sectional view of FIG. 3 taken along section lines 4—4.
Figure 7:
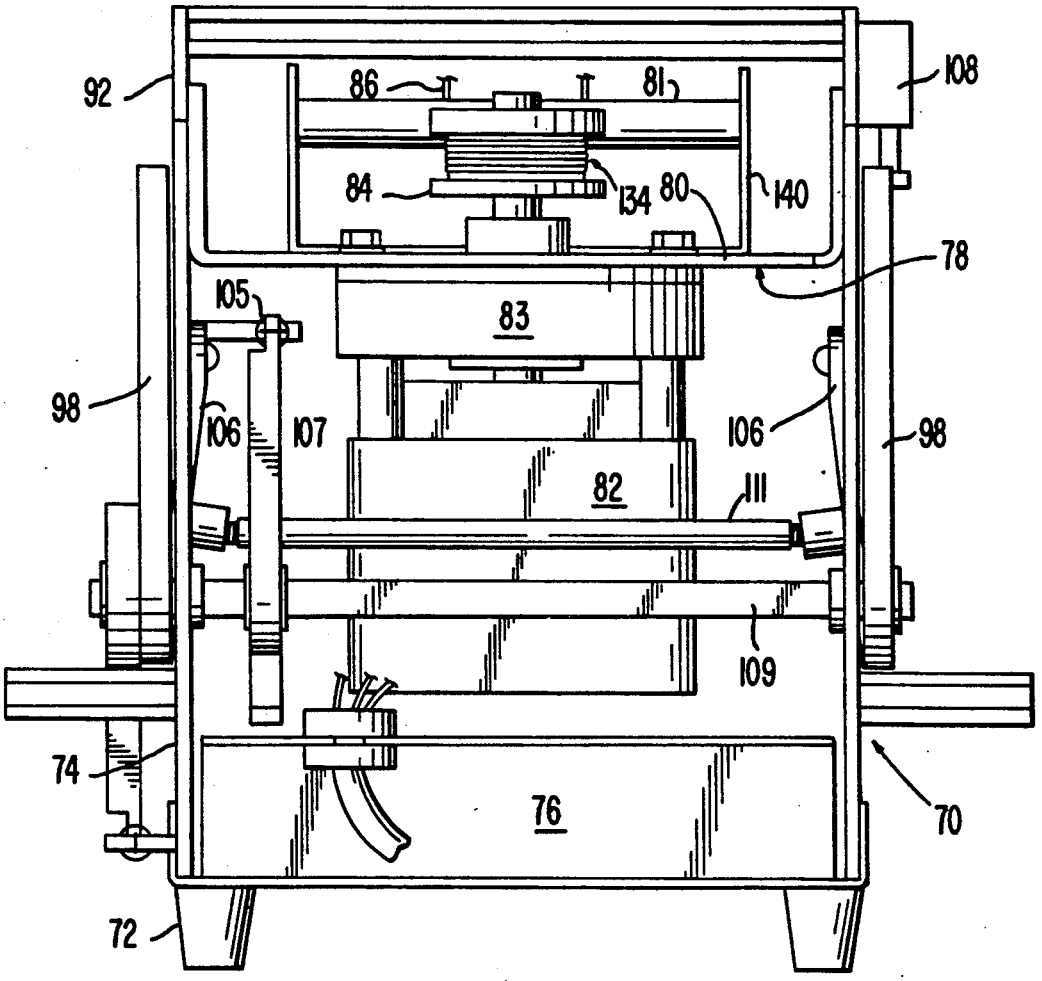
FIG. 7 illustrates an end elevational view of an imprinter in accordance with the present invention.
Figure 8:
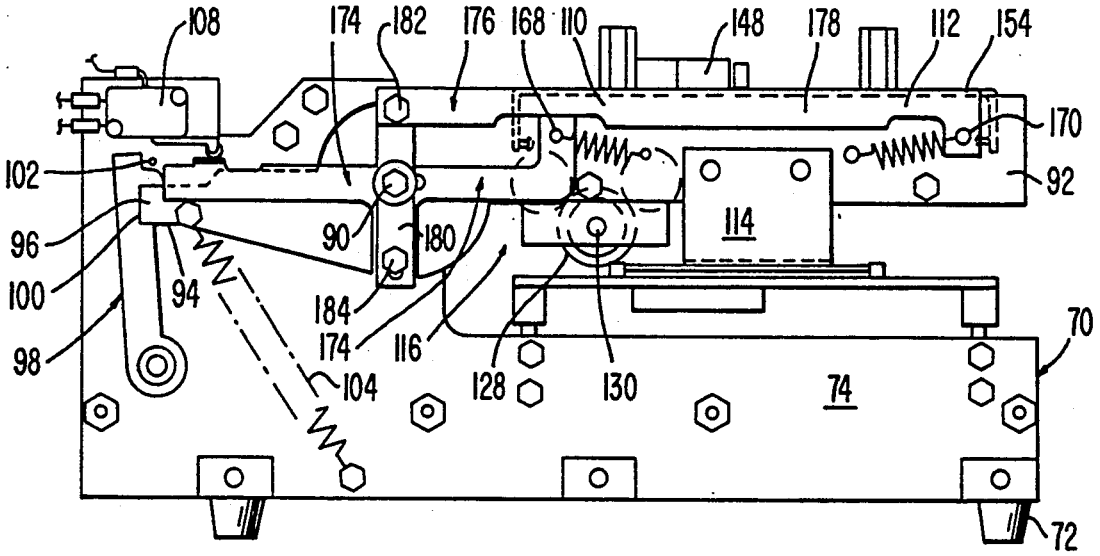
FIG. 8 illustrates a side elevational view with the head mechanism in the closed position.
Figure 9:
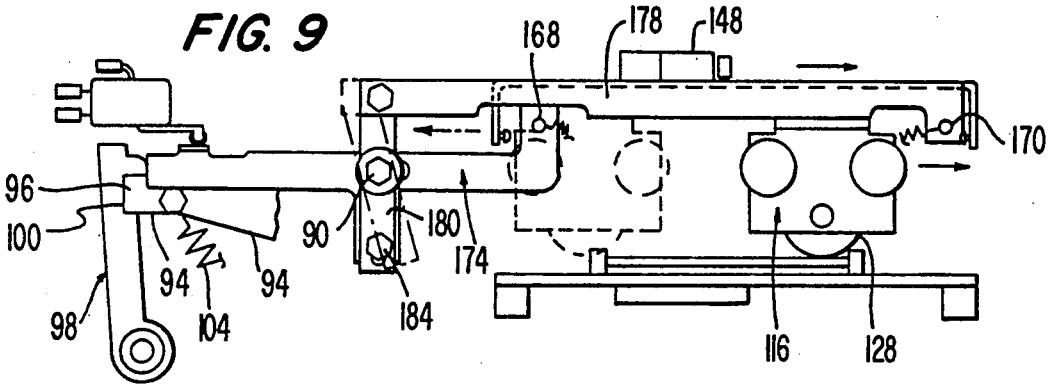
FIGS. 9 and 10 illustrate successive views of the latching mechanism and control mechanism for activating the electric motor driving the carriage during movement of the carriage in one of its directions of travel for an imprinting cycle.
Figure 10:
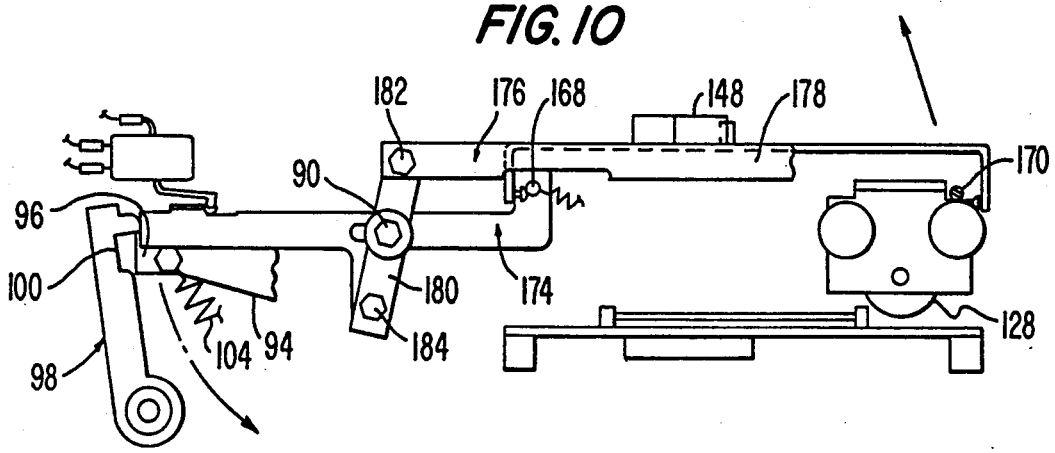

FIGS. 2-10 illustrate different parts and operational sequences of an imprinter 60 in accordance with the present invention in which like reference numerals identify like parts. The head 61 of the imprinter 60 is positioned in an open and a closed position during its operation in producing an imprint as illustrated in FIGS. 3 and 8. In the open position, as illustrated in FIGS. 2 and 3, the imprinter 60 receives a print bearing element 62 which contains characters to be imprinted on a formset 64 which is positioned on top of the print bearing element. The formset 64 may be in accordance with those used for imprinting in the prior art. Additionally, additional print bearing elements may be permanently attached to the imprinter such as a dater 66. As a consequence of the opening of the imprinter with a pivot axis offset from the surface 67 of the base (not illustrated) which receives the print bearing element 62 and formset 64, formsets having substantial length and width may be imprinted during repeated cycles at different positions on the formset such as is conventionally performed by imprinters in hospital applications. As illustrated, the imprinter 60 is pivoted closed as suggested by the arrow in FIG. 2 to latch the head 61 in the closed position as illustrated in FIG. 8 causing the imprinter motor 82 of FIG. 7 to be activated to perform imprinting as described below.

Figure 1:
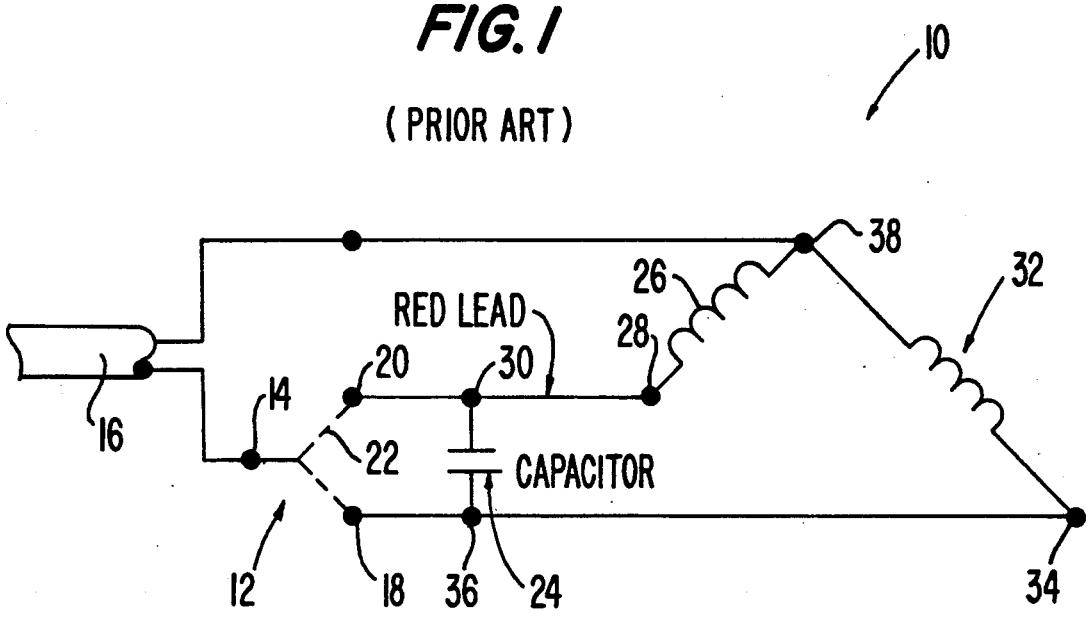
FIG. 1 (PRIOR ART)
FIG. 1 illustrates a prior art control mechanism for a reversible electric motor which may be used in the practice of the present invention.

FIGS. 3–10 illustrate detailed view of parts of the imprinter 60 to facilitate understanding the structure of the imprinter and the operation and interaction of the parts. With reference to FIGS. 3, 7 and 8 the imprinter 60 has a base 70 to which are attached multiple feet 72 to position the base on a horizontal surface where imprinting is to be performed. The base 70 is formed from a plurality of sheet metal sections such as side sections 74, bottom section 76 and motor containment housing 78 which has a horizontal surface 80 to which is attached an idler support which forms a pivot axis for part of the flexible transmission as described below. The motor 82 is controlled with an electrical circuit as described above in conjunction with the prior art of FIG. 1 which is activated by a control as described below. The output of the reversible motor 82 drives a gearbox 83 which is attached to the motor containment housing 78. The gearbox 83 drives a capstan 84 to which a flexible cable 86 is attached which bends around support 81 upon pivoting of the head 61 about pivot axis 90 which is orthogonal to the longitudinal axis of the base 70 of the imprinter 60. Suitable fasteners attach side plates 92 of the head 61 to the base 70 at the pivot axis 90.

The head 61 is light in weight in comparison to imprinters of the prior art which mount the motor in the head. As has been explained above, mounting of the motor in the head which is pivoted between open and closed positions after extended usage may result in problems where the head flies open at the end of the imprinting cycle which causes the imprinter to tip as a consequence of the inertia of the head hitting a stop which is objectionable to users. The head 61 of the imprinter of the present invention has a pair of extensions 94 having a squared off end 96 which mates with a notch 100 in a pair of latches 98. The latches 98 are biased by springs 105 to rotate in a clockwise direction against the stop which may be an allenhead screw. Rotation of the head from the open position is illustrated in FIG. 3 to the closed position in FIG. 8 against the spring bias provided by springs 104 causes contact between the top most corner part of the squared off end 96 with the edge of the latches 98 facing the squared off end to cause rotation of the latches in a counterclockwise direction to permit the squared off end 96 to drop within the notch 100 to complete latching of the head in the closed position. The latches 98 are biased to rotate in the clockwise direction by spring 105 which applies torque through member 107 to shaft 109 on which the latches are mounted. A pair of a head arrestors 106, which are attached to the base 70 at a position behind the latches 96 and further are connected together by a connecting rod 111, frictionally engage a surface of the latches facing the outside surface of the side sections 74 of the base 70 to provide suitable damping to prevent the head 61 from rotating from the closed position to the open position at too high of a rate of speed as a consequence of the force exerted by the stretched springs 104. Switch 108, which has open and closed positions, as respectively illustrated in FIGS. 3 and 8, controls the flow of electric current from an electrical source of alternating current which drives the reversible motor 82 as a consequence of the switch being in series with one of the electrical connectors contained within the plug which connects the motor to the source of alternating current. The switch 108 may be in series with the electrical connector which is connected to the terminal 38 of the prior art reversible motor of FIG. 1. As illustrated in FIG. 3, the switch is in an open position which disables the electric motor from imprinting and, as illustrated in FIG. 8, is in a closed position which permits current to flow to the motor.

The head 61, which is pivotable between the open and closed positions illustrated in FIGS. 3 and 8 respectively, supports a carriage 116 which is movable between ends of travel 110 and 112 respectively located at ends of the carriage support portion of the head. A downwardly extending bracket 114 is attached to a first side of the portion of the head 61. The function of the bracket 114 is to hold the print bearing element 62 and the formset 64 in a fixed position when the head 61 is rotated to the closed position as illustrated in FIG. 8.

The head 61 contains a pair of rails 118 mounted in the head which each have a first surface 120 for limiting movement of the movable carriage 116 in a third direction of carriage movement which is perpendicular to the first and second direction of carriage movement during imprinting between one end 110 of travel and the other end 112 of travel. It shall be understood that the present invention imprints during movement of the carriage in a first direction and during movement in a second direction opposite to the first direction in order to speed up the imprinting process. A plurality of rollers 122 are mounted in first and second sides 124 and 126 of the carriage 116. A rolling platen 128 is attached to the sides 124 and 126 through an aperture which receives an axle 130 on which the rolling platen is mounted. The plurality of rollers 122 are mounted outboard of the rolling platen 128 and engage a second surface 132 of the rails 118 which is opposed to the first surface 120 to rotatably support the carriage 116 during imprinting and to limit movement of the movable carriage in a fourth direction of carriage movement perpendicular to the first and second directions of carriage movement during imprinting which is opposite to the third direction of carriage movement. As illustrated, the carriage 116 alternatively moves between the ends of travel 110 and 112 during successive imprinting cycles to provide rapid imprinting without the requirement of many prior art imprinters in which the rolling platen is returned to a home position. This rapid movement is perceived by users of the imprinter to be desirable and simplifies the overall operation of the imprinter 60.

The movable carriage 116, which is mounted in the head 61, is driven by a transmission 134 coupling the electric motor 82 to the carriage to move the platen 128 in a first and a second opposite direction with movement in each direction to one of the ends of travel 110 and 112 to imprint print from the print bearing element 62 onto the print receiving element which is the formset 64. The transmission 134 couples the electric motor 82 to the carriage 116 with a flexible coupling which bends at a pivot point about idler 81 which is rotatably mounted in a pair of upwardly extending arms 140 which are attached to the horizontal surface 80 of the motor containment housing 78. The flexible coupling is comprised of a cable 86 which is attached to the capstan 84 which forms a loop between the capstan and an idler wheel 142 which is attached to a head at a position adjacent to the end of travel 112 located farthest from the capstan 84. The cable 86 is attached longitudinally to the movable carriage 116 along a single longitudinal section 146 which may be in the form of a pair of channels which receive respective ends of the cable which are held in place by a clamp 150. The loop formed by the cable 86 is attached to the carriage 116 inboard of the rollers 122. The flexible transmission 134 which utilizes the cable 86 which is attached to the carriage 116 along the single longitudinal section 146 substantially simplifies the coupling of power to the carriage from the electric motor 82 as in prior art imprinters by lessening the overall mass and expense of the transmission without sacrificing reliability. Furthermore, the lightening of the transmission 134 lightens the overall head assembly which reduces the mass of the overall imprinter which is one of the disadvantages of many prior art electrically driven imprinters especially those which are intended for special applications, such as in hospitals, where large formsets are imprinted.

Figure 6:
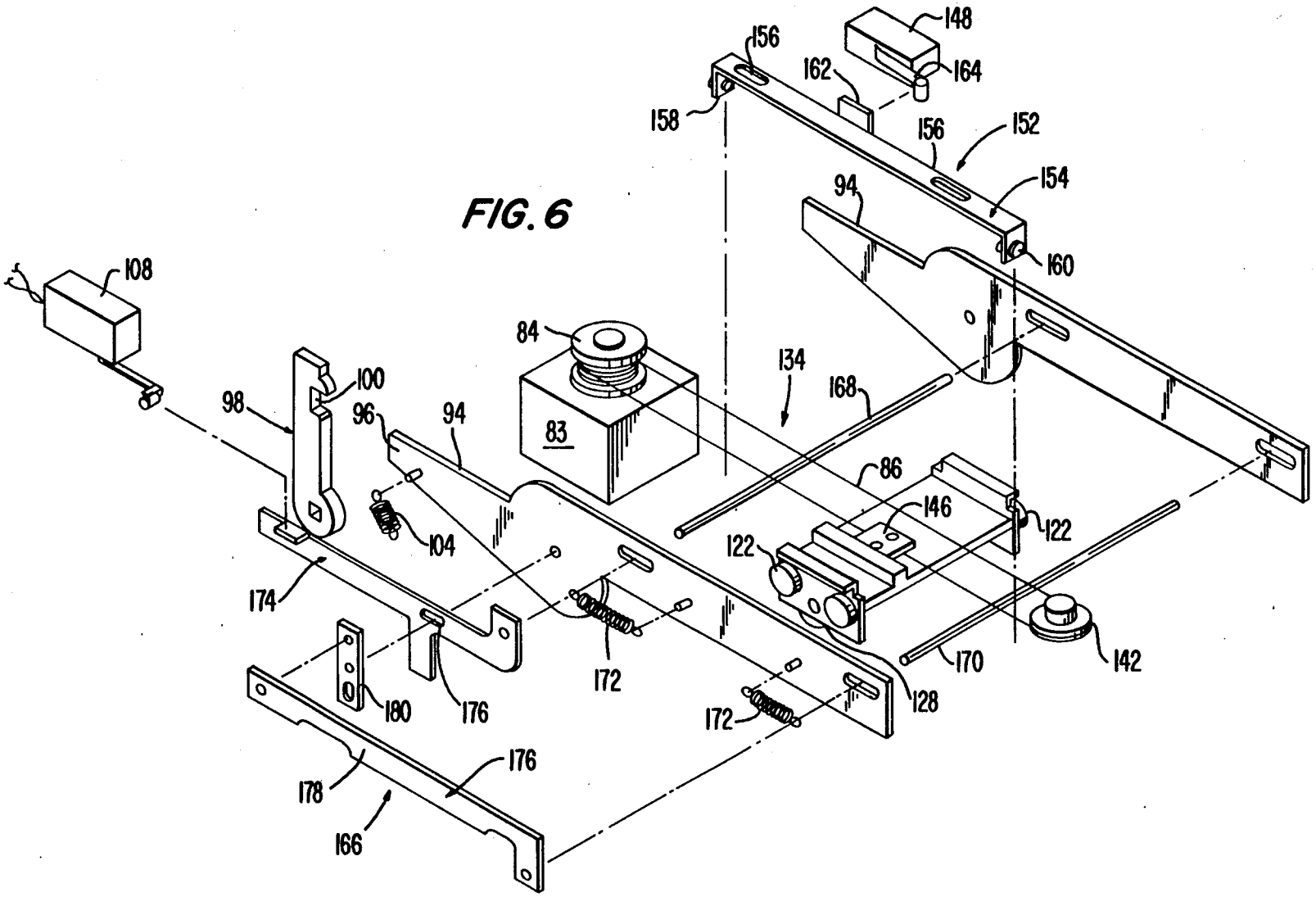
FIG. 6 illustrates an exploded view of control mechanisms and the transmission for driving the head.

The rolling platen 128 performs imprinting in first and second opposite directions of carriage movement which increases the speed of the imprinting cycle over imprinters which imprint in only one direction and return the rolling platen to the home position for the next imprinting cycle. The transmission 134 is driven by a reversible motor 82 which has the direction of rotation controlled by a switch 148 electrically connected to the motor 82 and capacitor 24 as illustrated in the prior art of FIG. 1. In FIG. 6, the opening and closing of the switch 148 is controlled by a first control mechanism 152. The first control mechanism 152 is comprised of a member 154 which is slidably attached to the head 61 by a pair of fasteners which extend through slots 156 to permit longitudinal movement of the member parallel to the longitudinal axis of the base 70 and the longitudinal axis of the head 61. The member 154 moves parallel to the direction of travel of the carriage 116 when the carriage moves to the respective ends of travel 110 and 112 to contact a first stop 158 and a second stop 160. The first stop 158 is contacted by the carriage 116 reaching the end of travel 110 and the second stop 160 is contacted by the carriage reaching the end of travel 112. The member 154 has an upward projection 162 which intercepts switch activator 164 which activates the pole which is equivalent to the pole 22 of the prior art of FIG. 1. As a result, the first terminal of the switch 148 is connected to a second terminal which is equivalent to the terminal 18 of FIG. 1 when the first stop 158 is contacted by the carriage 116 and is connected to a third terminal which is equivalent to the terminal 20 of FIG. 1 when the second stop 116 is contacted by the carriage. As a result, alternating imprinting cycles are performed by the projection 162 controlling the position of the switch 148 to control the direction of rotation of the motor 82 as described above with reference to the prior art of FIG. 1.

A second control mechanism 166 controls the conductivity of the switch 108 as described above and further the unlatching of the latches 98 in response to movement of the carriage 116 to the ends of travel 110 and 112. The second control mechanism 166 is slidably attached to the head 61 by the fasteners which form the pivot axis 90. The second control mechanism 166 is movable between first and second positions with the first position not opening the latches 98 and the second position contacting the latches and opening the latches to permit the head 61 to pivot to the open position. The second control mechanism 166 includes a first carriage stop 168 which is movable parallel to the directions of travel of the carriage 116 and which contacts the carriage 116 at one end of travel 110 of the carriage and causes the latches 98 to open as the carriage approaches the one end of travel and a second carriage stop 170 which is movable parallel to the direction of travel which contacts the carriage at another end of travel 112 of the head 61 and causes the latches to open as the carriage approaches the another end of travel. The first and second carriage stops 168 and 170 are biased by springs 172 to be pulled toward the center of travel of the carriage 116 in the head 61. A first member 174 is attached to the first carriage stop 168 which engages the latches 98 to open the latches when the carriage approaches the end of travel. Slot 176 permits the member 174 to slide longitudinally with respect to the fasteners forming the pivot axis 90. As is apparent, movement of the carriage 116 to the end of travel 110 causes the carriage stop 168 to move outward away from the longitudinal center of the head 61 to force the latches 98 to rotate counterclockwise to permit the head 61 to move to the open position. The second control mechanism 166 further includes a second member 177 which is attached to the second carriage stop 170 and to the first member 174 which engages the latches 98 to open the latches when the carriage approaches the other end of travel 112. The second member 177 has first part 178 and a second part 180 which are pivotally attached together by connector 182. The first part 178 is attached to the carriage stop 170 and the second part 180 is pivotally attached to the head 61 at the fasteners which form the pivot axis 90 at a point offset from the pivotal attachment of the first and second parts 178 and 180. Furthermore, the second part 180 is pivotally attached to the first member 174 by a fastener 184 at a point offset from the pivot point of attachment of the second part to the head 61 with a distance between the pivot point of the parts 178 and 180 and the point of attachment of the second part to the first member 174 being greater than a distance between the pivot point of the parts and the point of attachment of the second member 177 to the head. Contacting of the first carriage stop 168 with the carriage 116 causes the first member to rotate the latches 98 counterclockwise and contacting of the carriage with the second carriage stop 170 causes the first part 178 of the second member 177 to rotate the second part 180 clockwise causing the first member 174 to also rotate the latches counterclockwise to open the head. As is apparent, contacting of either stop 168 or 170 produces counterclockwise motion of the latches 98 causing the head 61 to open which deactivates the motor 82 as soon as the upward rotation of the head 61 causes the first member 174 to rotate counterclockwise which removes contact with the switch follower causing the switch 108 to open.

While the invention has been described in terms of its preferred embodiments, it should be understood that numerous modifications may be made thereto without departing from the spirit and scope of the invention as defined in the appended claims. It is intended that all such modifications fall within the scope of the appended claims.

We claim:

1. An electric motor driven imprinter comprising:

an electric motor having first and second motor windings each having a first terminal for coupling to a source of electric power and a second terminal connected together and for coupling to the source of electric power;

a base for receiving a print bearing element having printing to be imprinted and a print receiving element to be imprinted with the electric motor being attached to the base;

a head pivotally connected to the base which is pivoted between an open position providing access to the base and a closed position positioning the heat for imprinting;

a movable carriage mounted in the head having mounted therein a rolling platen with the carriage being driven by a transmission coupling the electric motor to the carriage to move the carriage in a first and a second opposite direction with movement in each direction to one of a pair of ends of travel imprinting print from the print bearing element on the print receiving element;

a first switch having a first terminal for connection to the source of electrical power and alternatively to one of second and third switch terminals respectively electrically connected to the first terminal of the first and second motor windings and connected to a capacitor with the alternative connection to the second and third switch terminals being controlled by a first control mechanism which is activated when the carriage moves to the end of travel in either the first or second direction; and a second switch coupled to the motor windings with the second switch being controlled by a second control mechanism to close the second switch in response to pivoting the head to the closed position so that current flows through the closed second switch through the electric motor and the electric motor is activated when current flows through the switches and the motor windings from the source of electrical power with the direction of rotation being controlled by the end of travel at which the carriage is positioned at the time of closing the head.

2. An imprinter in accordance with claim 1 wherein:

the transmission couples the electric motor to the carriage with a flexible coupling which bends upon pivoting of the head.

3. An imprinter in accordance with claim 2 wherein the transmission comprises:

a capstan which is driven by the motor to rotate in first and second rotational directions; and a cable attached to the capstan, forming a loop between the capstan and an idler wheel attached to the head and attached to the movable carriage so that rotation of the capstan in the first rotational direction moves the carriage in the first direction and rotation of the capstan in the second rotational direction moves the carriage in the second direction.

4. An imprinter in accordance with claim 3 wherein:

capstan is attached to the base; and further comprising an idler rotatably attached to the base against which the loop rests when the head is pivoted to the open position to form a pivot point of the loop between the base and the head when the head is in the open position.

5. An imprinter in accordance with claim 3 further comprising:

a pair of rails mounted in the head each having a first surface which engages the carriage for limiting movement of the movable carriage in a third direction of carriage movement which is perpendicular to the first and second directions;

a plurality of rollers mounted in first and second sides of the carriage outboard of the rolling platen which engage a second surface of the pair of rails opposed to the first surface to rotatably support the carriage during imprinting and limit movement of the movable carriage in a fourth direction of carriage movement opposite to the third direction of carriage movement; and wherein the loop is longitudinally attached to the carriage inboard of the rollers.

6. An imprinter in accordance with claim 5 wherein:

capstan is attached to the base; and further comprising an idler rotatably attached to the base against which the loop rests when the head is pivoted to the open position to form a pivot point of the loop between the base and the head when the head is in the open position

7. An imprinter in accordance with claim 1 wherein the first control mechanism comprises:

a member slidably attached to the head to move parallel to the first and second directions of travel and having first and second stops disposed at opposed ends of the member which respectively are contacted by movement of the carriage to each end of travel with contact of the carriage with the first stop causing the first terminal of the first switch to be connected to the second terminal of the first switch and with contact with the second stop causing the first terminal of the first switch to be connected to the third terminal of the first switch.

8. An imprinter in accordance with claim 2 wherein the first control mechanism comprises:

a member slidably attached to the head to move parallel to the first and second directions of travel and having first and second stops disposed at opposed ends of the member which respectively are contacted by movement of the carriage to each end of travel with contact of the carriage with the first stop causing the first terminal of the first switch to be connected to the second terminal of the first switch and with contact with the second stop causing the first terminal of the first switch to be connected to the third terminal of the first switch.

9. An imprinter in accordance with claim 3 wherein the first control mechanism comprises:

a member slidably attached to the head to move parallel to first and second the directions of travel and having first and second stops disposed at opposed ends of the member which respectively are contacted by movement of the carriage to each end of travel with contact of the carriage with the first stop causing the first terminal of the first switch to be connected to the second terminal of the first switch and with contact with the second stop causing the first terminal of the first switch to be connected to the third terminal of the first switch.

10. An imprinter in accordance with claim 4 wherein the first control mechanism comprises:

a member slidably attached to the head to move parallel to the first and second directions of travel and having first and second stops disposed at opposed ends of the member which respectively are contacted by movement of the carriage to each end of travel with contact of the carriage with the first stop causing the first terminal of the first switch to be connected to the second terminal of the first switch and with contact with the second stop causing the first terminal of the first switch to be connected to the third terminal of the first switch.

11. An imprinter in accordance with claim 5 wherein the first control mechanism comprises:

a member slidably attached to the head to move parallel to the first and second directions of travel and having first and second stops disposed at opposed ends of the member which respectively are contacted by movement of the carriage to each end of travel with contact of the carriage with the first stop causing the first terminal of the first switch to be connected to the second terminal of the first switch and with contact with the second stop causing the first terminal of the first switch to be connected to the third terminal of the first switch.

12. An imprinter in accordance with claim 6 wherein the first control mechanism comprises:

a member slidably attached to the head to move parallel to the first and second directions of travel and having first and second stops disposed at opposed ends of the member which respectively are contacted by movement of the carriage to each end of travel with contact of the carriage with the first stop causing the first terminal of the first switch to be connected to the second terminal of the first switch and with contact with the second stop causing the first terminal of the first switch to be connected to the third terminal of the first switch.

13. An imprinter in accordance with claim 1 wherein:

a latching mechanism engages the head and the second control mechanism is slidably attached to the head and movable between first and second positions with the first position not opening the latching mechanism and the second position contacting the latching mechanism and opening the latching mechanism to permit the head to pivot to the open position.

14. An imprinter in accordance with claim 13 wherein the second control mechanism comprises:

a first carriage stop which is movable parallel to the first and second directions of travel of the carriage which contacts the carriage at one end of travel of the carriage and causes the latching mechanism to open as the carriage approaches the one end of travel; and a second carriage stop which is movable parallel to the first and second directions of travel of the carriage which contacts the carriage at another end of travel of the head and causes the latching mechanism to open as the carriage approaches the another end of travel.

15. An imprinter in accordance with claim 14 wherein the second control mechanism further comprises:

a first member attached to the first carriage stop which engages the latching mechanism to open the latching mechanism when the carriage approaches one end of travel; and a second member attached to the second carriage stop and to the first member which engages the latching mechanism to open the latching mechanism when the carriage approaches the other end of travel.

16. An imprinter in accordance with claim 15 wherein:

the second member has two parts which are pivotally attached together, the first part being attached to one of the carriage stops and the second part being pivotally attached to the head at a point offset from the pivotal attachment to the first part and pivotally attached to the first member at a point offset from the pivot point of attachment to the head with a distance between the pivot point of the parts and the point of attachment of the second part of the first member being greater than a distance between the pivot point of the parts and the point of attachment of the second member to the head.

17. An electric motor driven imprinter comprising:

an electric motor;

a base for receiving a print bearing element having printing to be imprinted and a print receiving element to be imprinted with the electric motor being mounted in the base;

a head pivotally connected to the base which is pivotable between an open position providing access to the base and a closed position positioning the head for imprinting with a pivot axis of the head being orthogonal to a longitudinal axis of the base and the head being pivotally attached to the base at a position on the longitudinal axis of the base longitudinally offset from a portion of the base receiving the print bearing element and the print receiving element;

a movable carriage mounted in the head having mounted therein a rolling platen driven by the electric motor to move the carriage in a first direction and a second opposite direction along the longitudinal axis with movement in each direction to one of a pair of ends of travel imprinting print from the print bearing element on the print receiving element;

a capstan which is driven by the motor to rotate in first and second rotational directions with the motor and capstan being attached to the base at a position farther away from the print bearing element than a point of the pivotal attachment of the head; and a cable attached to the capstan, forming a loop between the capstan and an idler wheel attached to the head at a point along a longitudinal axis of the head adjacent an end of travel of the carriage spaced farthest from the capstan and attached to the movable carriage so that rotation of the capstan in the first rotational direction moves the carriage in the first direction and rotation of the capstan in the second rotational direction moves the carriage in the second direction.

18. An imprinter in accordance with claim 17 further comprising:

an idler attached to the base adjacent an end of travel closest to the capstan against which the loop rests when the head is pivoted to the open position to form a pivot point of the loop between the base and the head when the head is in the open position.

19. An imprinter in accordance with claim 18 further comprising:

a pair of rails mounted in the head each having a first surface which engages the carriage for limiting movement of the movable carriage in a third direction of carriage movement which is perpendicular to the first and second directions;

a plurality of rollers mounted in first and second sides of the carriage outboard of the rolling platen which engage a second surface of the pair of rails opposed to the first surface to rotatably support the carriage during imprinting and limit movement of the movable carriage in a fourth direction of carriage movement opposite to the third direction of carriage movement; and wherein the loop is attached longitudinally to the carriage inboard of the rollers.

20. An imprinter in accordance with claim 17 further comprising:

a latching mechanism for latching the head in the closed position so that imprinting may be performed; and a control mechanism slidably attached to the head and movable between first and second positions with the first position not opening the latching mechanism and the second position contacting the latching mechanism and opening the latching mechanism to pivot to the open position.

21. An imprinter in accordance with claim 20 wherein the control mechanism comprises:

a first carriage stop which is movable parallel to the first and second directions of travel which contacts the carriage at one end of travel of the carriage and causes the latching mechanism to open as the carriage approaches the one end of travel; and a second carriage stop which is movable parallel to the direction of travel which contacts the carriage at another end of travel of the carriage and causes the latching mechanism to open as the carriage approaches the another end of travel.

22. An imprinter in accordance with claim 21 wherein the control mechanism further comprises:

a first member attached to the first carriage stop which engages the latching mechanism to open the latching mechanism when the carriage approaches the end of travel; and a second member attached to the second carriage stop and to the first member which engages the latching mechanism to open the latching mechanism when the carriage approaches the other end of travel.

23. An imprinter in accordance with claim 22 wherein:

the second member has two parts which are pivotally attached together, the first part being attached to one of the carriage stops and the second part being pivotally attached to the head at a point offset from the pivotal attachment to the first part and pivotally attached to the first member at a point offset from the pivot point of attachment to the head with a distance between the pivot point of the parts and the point of attachment of the second part of the first member being greater than a distance between the pivot point of the parts and the point of attachment of the second member to the head.

24. An imprinter in accordance with claim 18 further comprising:

a latching mechanism for latching the head in the closed position so that imprinting may be performed; and a control mechanism slidably attached to the head and movable between first and second positions in response to movement of the carriage with the first position not opening the latching mechanism and the second position contacting the latching mechanism and opening the latching mechanism to pivot to the open position.

25. An imprinter in accordance with claim 24 wherein the control mechanism comprises:

a first carriage stop which is movable parallel to the first and second directions of travel of the carriage which contacts the carriage at one end of travel of the carriage and causes the latching mechanism to open as the carriage approaches the one end of travel; and a second carriage stop which is movable parallel to the first and second directions of travel of the carriage which contacts the carriage at another end of travel of the head and causes the latching mechanism to open as the carriage approaches the another end of travel.

26. An imprinter in accordance with claim 25 wherein the control mechanism further comprises:

a first member attached to the first carriage stop which engages the latching mechanism to open the latching mechanism when the carriage approaches the first end of travel; and a second member attached to the second carriage stop and to the first member which engages the latching mechanism to open the latching mechanism when the carriage approaches the second end of travel.

27. An imprinter in accordance with claim 26 wherein:

the second member has two parts which are pivotally attached together, the first part being attached to one of the carriage stops and the second part being pivotally attached to the head at a point offset from the pivotal attachment to the first part and pivotally attached to the first member at a point offset from the pivot point of attachment to the head with a distance between the pivot point of the parts and the point of attachment of the second part of the first member being greater than a distance between the pivot point of the parts and the point of attachment of the second member to the head.

28. An imprinter in accordance with claim 19 further comprising:

a latching mechanism for latching the head in the closed position so that imprinting may be performed; and a control mechanism slidably attached to the head and movable between first and second positions with the first position not opening the latching mechanism and the second position contacting the latching mechanism and opening the latching mechanism to pivot to the open position.

29. An imprinter in accordance with claim 28 wherein the control mechanism comprises:

a first carriage stop which is movable parallel to the first and second directions of travel of the carriage which contacts the carriage at one end of travel of the carriage and causes the latching mechanism to open as the carriage approaches the first end of travel; and a second carriage stop which is movable parallel to the first and second directions of travel of the carriage which contacts the carriage at the second end of travel of the carriage and causes the latching mechanism to open as the carriage approaches the second end of travel.

30. An imprinter in accordance with claim 29 wherein the control mechanism further comprises:

a first member attached to the first carriage stop which engages the latching mechanism to open the latching mechanism when the carriage approaches the first end of travel; and a second member attached to the second carriage stop and to the first member which engages the latching mechanism to open the latching mechanism when the carriage approaches the second end of travel.

31. An imprinter in accordance with claim 30 wherein:

the second member has two parts which are pivotally attached together, the first part being attached to one of the carriage stops and the second part being pivotally attached to the head at a point offset from the pivotal attachment to the first part and pivotally attached to the first member at a point offset from the pivot point of attachment to the head with a distance between the pivot point of the parts and the point of attachment of the second part of the first member being greater than a distance between the pivot point of the parts and the point of attachment of the second member to the head.

32. An imprinter driven by a reversible electric motor comprising:

a base for receiving a print bearing element having printing to be imprinted and a print receiving element to be imprinted with the electric motor being mounted in the base;

a head pivotally connected to the base which is pivotable between an open position providing access to the base and a closed position positioning the head for imprinting;

a movable carriage mounted in the head having mounted therein a rolling platen driven by a transmission coupling the electric motor to move the carriage in a first and a second opposite direction with movement in each direction to one of first and second of ends of travel imprinting print from the print bearing element on the print receiving element with rotation of the electric motor in a first rotational direction causing the carriage to move in the first direction and with rotation of the electric motor in the second rotational direction causing the carriage to rotate in the second direction; and a member slidably attached to the head to move parallel to the first and second directions of travel and having first and second stops disposed at opposed ends of the member which respectively are contacted by movement of the carriage to each end of travel with contact of the carriage with the first stop causing the motor to rotate in the first rotational direction when electric power is applied to the motor and with contact of the carriage with the second stop causing the motor to rotate in the second rotational direction.

33. An imprinter in accordance with claim 32 further comprising:

a pair of rails mounted in the head each having a first surface which engages the carriage for limiting movement of the movable carriage in a third direction of carriage movement which is perpendicular to the first and second directions of carriage movement;

a plurality of rollers mounted in first and second sides of the carriage outboard of the rolling platen which engage a second surface of the pair of rails opposed to the first surface to rotatably support the carriage during imprinting and limit movement of the movable carriage in a fourth direction of carriage movement opposite to the third direction of carriage movement.

34. An imprinter in accordance with claim 33 wherein:

the transmission couples the electric motor to the carriage with a flexible coupling which bends upon pivoting of the head.

35. An imprinter in accordance with claim 34 wherein the transmission comprises:

a capstan which is driven by the motor to rotate in first and second rotational directions; and a cable attached to the capstan, forming a loop between the capstan and an idler wheel attached to the head and attached to the movable carriage so that rotation of the capstan in the first rotational direction moves the carriage in the first direction and rotation of the capstan in the second rotational direction moves the carriage in the second direction.

36. An imprinter in accordance with claim 35 wherein:

the capstan is attached to the base; and further comprising an idler rotatably attached to the base against which the loop rests when the head is pivoted to the open position.

37. An imprinter in accordance with claim 36 wherein:

the loop is attached to the carriage along a single longitudinal section of carriage inboard of the rollers.

38. An imprinter in accordance with claim 37 wherein:

a pivot axis of the head is orthogonal to a longitudinal axis of the base and the head is pivotally attached to the base at a position on the longitudinal axis of the base longitudinally offset from a portion of the base receiving the print bearing element and the print receiving element.

* * * * *